US010724125B2

(12) United States Patent
Suzuki et al.

(10) Patent No.: US 10,724,125 B2
(45) Date of Patent: Jul. 28, 2020

(54) SPRING STEEL

(71) Applicant: NIPPON STEEL & SUMITOMO METAL CORPORATION, Tokyo (JP)

(72) Inventors: Takahisa Suzuki, Hokkaido (JP); Manabu Kubota, Nishinomiya (JP); Shuji Kozawa, Hokkaido (JP); Hirotsugu Miyamoto, Kisarazu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 127 days.

(21) Appl. No.: 15/573,076

(22) PCT Filed: May 13, 2016

(86) PCT No.: PCT/JP2016/064319
§ 371 (c)(1),
(2) Date: Nov. 9, 2017

(87) PCT Pub. No.: WO2016/186033
PCT Pub. Date: Nov. 24, 2016

(65) Prior Publication Data

US 2018/0142333 A1 May 24, 2018

(30) Foreign Application Priority Data

May 15, 2015 (JP) ..... 2015-100008

(51) Int. Cl.

| | |
|---|---|
| ***C22C 38/54*** | (2006.01) |
| ***C22C 38/00*** | (2006.01) |
| ***C21D 9/02*** | (2006.01) |
| ***C22C 38/02*** | (2006.01) |
| ***C22C 38/04*** | (2006.01) |
| ***C22C 38/06*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| *C21D 8/06* | (2006.01) |

(52) U.S. Cl.
CPC ..... *C22C 38/54* (2013.01); *C21D 9/02* (2013.01); *C22C 38/00* (2013.01); *C22C 38/001* (2013.01); *C22C 38/02* (2013.01); *C22C 38/04* (2013.01); *C22C 38/06* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C21D 8/065* (2013.01)

(58) Field of Classification Search
CPC ..... C21D 8/065; C21D 9/02; C22C 38/00
USPC ..... 420/91
See application file for complete search history.

(56) References Cited

U.S. PATENT DOCUMENTS

| | | | | |
|---|---|---|---|---|
| 5,776,267 | A | 7/1998 | Nanba et al. | |
| 6,406,565 | B1 | 6/2002 | Hashimura et al. | |
| 8,192,562 | B2 * | 6/2012 | Yoshihara | C21D 8/06 148/330 |
| 9,023,159 | B2 * | 5/2015 | Hatano | C21D 6/005 148/567 |
| 2009/0020195 | A1 * | 1/2009 | Kubota | C21D 1/42 148/580 |
| 2010/0034691 | A1 | 2/2010 | Yoshihara | |
| 2011/0091348 | A1 | 4/2011 | Hatano et al. | |
| 2011/0155290 | A1 | 6/2011 | Miyanishi et al. | |
| 2012/0018050 | A1 | 1/2012 | Kubota et al. | |
| 2012/0256361 | A1 | 10/2012 | Sugimoto et al. | |
| 2015/0004051 | A1 | 1/2015 | Honjo et al. | |

FOREIGN PATENT DOCUMENTS

| | | | |
|---|---|---|---|
| CN | 101717893 | A | 6/2010 |
| CN | 102131945 | A | 7/2011 |
| CN | 102341520 | A | 2/2012 |
| CN | 104114732 | A | 10/2014 |
| EP | 1698712 | A1 | 9/2006 |
| EP | 1990436 | A1 | 11/2008 |
| JP | 57-032353 | A | 2/1982 |
| JP | 10-196697 | A | 7/1998 |
| JP | 11-029839 | A | 2/1999 |
| JP | 2001-049337 | A | 2/2001 |
| JP | 2004-10965 | A | 1/2004 |
| JP | 2004-143482 | A | 5/2004 |
| JP | 2008-127596 | A | 6/2008 |
| JP | 2008-133539 | A | 6/2008 |
| JP | 2010-001525 | A | 1/2010 |
| JP | 2011-127182 | A | 6/2011 |
| KR | 10-2009-0010155 | A | 1/2009 |
| KR | 10-2011-0009252 | A | 1/2011 |
| WO | WO 2014/174587 | A1 | 10/2014 |

OTHER PUBLICATIONS

Chinese Office Action and Search Report, dated Sep. 28, 2018, for Chinese Application No. 201680027565.6, with an English translation of the Search Report.

(Continued)

*Primary Examiner* — Jie Yang
(74) *Attorney, Agent, or Firm* — Birch, Stewart, Kolasch & Birch, LLP

(57) ABSTRACT

Spring steel includes: as a chemical composition, by mass %, C: 0.40% to 0.60%, Si: 0.90% to 2.50%, Mn: 0.20% to 1.20%, Cr: 0.15% to 2.00%, Ni: 0.10% to 1.00%, Ti: 0.030% to 0.100%, B: 0.0010% to 0.0060%, N: 0.0010% to 0.0070%, Cu: 0% to 0.50%, Mo: 0% to 1.00%, V: 0% to 0.50%, Nb: 0% to 0.10%, P: limited to less than 0.020%, S: limited to less than 0.020%, Al: limited to less than 0.050%, and a remainder including Fe and impurities, in a case where [Ti] represents a Ti content and [N] represents a N content by mass %, the chemical composition satisfies ([Ti]−3.43×[N])>0.03, and a total number density of a Ti carbide and a Ti carbonitride having a diameter of 5 nm to 100 nm is more than 50 piece/$\mu m^3$.

4 Claims, No Drawings

(56) References Cited

OTHER PUBLICATIONS

Extended European Search Report, dated Oct. 26, 2018, for European Application No. 16796426.1.
International Search Report (PCT/ISA/210) issued in PCT/JP2016/064319, dated Jul. 19, 2016.
Written Opinion (PCT/ISA/237) issued in PCT/JP2016/064319, dated Jul. 19, 2016.
Office Action dated Feb. 7, 2019, in Korean Patent Application No. 10-2017-7035319, with English translation.

* cited by examiner

SPRING STEEL

TECHNICAL FIELD OF THE INVENTION

The present invention relates to spring steel, particularly to spring steel having high strength and high toughness after quenching and tempering. This spring steel is suitable for a suspension spring.

Priority is claimed on Japanese Patent Application No. 2015-100008, filed on May 15, 2015, the content of which is incorporated herein by reference.

RELATED ART

Along with higher performance of automobiles, a suspension spring has also been caused to have higher strength, and some suspension springs has been used under shear stress of 1,100 MPa or more has been used. Therefore, spring steel having tensile strength of more than 1,800 MPa after a heat treatment is provided to manufacturing for a spring. For example, in Patent Document 1, elements such as V, Nb, and Mo are added to spring steel, in order to precipitate fine carbide of elements such as V, Nb, and Mo in steel after a heat treatment (quenching and tempering). D1 discloses settling resistance of steel is improved by limiting movements of dislocation, and tensile strength after a heat treatment is more than 1,800 MPa. In addition, recently, steel having a tensile strength of more than 2,000 MPa after a heat treatment has also been used as a spring material.

Spring steel is formed and used as a spring, so that ductility (particularly, reduction of area) for maintaining good formability and fracture properties for harsh operating environment are also required. However, it is well known that, as strength increases, a Charpy impact value (toughness) and ductility and the like decrease. In the spring steel disclosed in Patent Document 1, high strength in which tensile strength is 1,800 MPa or more can be obtained after a heat treatment (quenching and tempering), however the Charpy impact value thereof is not sufficient.

Patent Document 2 discloses that, spring steel having high strength and high toughness after quenching and tempering is obtained by refining a grain size of prior austenite of which grain boundaries thereof become origins of brittle fractures, using nitride, carbide, and carbonitride of Ti by adding Ti. Although, certain effects can be obtained in the techniques of Patent Document 2, it is difficult to satisfy the recent demand for higher toughness.

It is known that, a high strength spring become brittle and fatigue properties thereof deteriorate by penetration of hydrogen from the surrounding environment due to corrosion or the like. Patent Document 3 discloses spring steel including Ti precipitates for hydrogen trapping in which compressive residual stress is applied to a surface layer area by a shot-peening treatment, thereby embrittlement caused by penetration of hydrogen and deterioration in fatigue properties are suppressed.

However, a large amount of Ti also causes embrittlement of steel. So that, in a case of Ti addition, an amount of Ti should be suppressed, or an expensive alloying element such as Ni, Mo, and V is also required in combination with Ti addition in order to improve toughness. In addition, with respect to spring steel of Patent Document 3, a value of reduction of area after a heat treatment is low, and the risk for breakage of steel during spring processing is high, particularly when cold spring forming is performed, since a tempering temperature is limited to 340° C. or lower during manufacturing.

PRIOR ART DOCUMENT

Patent Document

[Patent Document 1] Japanese Unexamined Patent Application, First Publication No. S57-32353

[Patent Document 2] Japanese Unexamined Patent Application, First Publication No. H11-29839

[Patent Document 3] Japanese Unexamined Patent Application, First Publication No. 2001-49337

DISCLOSURE OF THE INVENTION

Problems to be Solved by the Invention

An object of the present invention is to provide a spring steel having a tensile strength of 1,800 MPa or more and having a high reduction of area, a high Charpy impact value, and a high resistance to hydrogen embrittlement, after heat treatment such as quenching and tempering.

Means for Solving the Problem

The present invention mainly relates to steel described below.

(1) A spring steel according to an aspect of the present invention includes: as a chemical composition, by mass %, C: 0.40% to 0.60%, Si: 0.90% to 2.50%, Mn: 0.20% to 1.20%, Cr: 0.15% to 2.00%, Ni: 0.10% to 1.00%, Ti: 0.030% to 0.100%, B: 0.0010% to 0.0060%, N: 0.0010% to 0.0070%, Cu: 0% to 0.50%, Mo: 0% to 1.00%, V: 0% to 0.50%, Nb: 0% to 0.10%, P: limited to less than 0.020%, S: limited to less than 0.020%, Al: limited to less than 0.050%, and a remainder including Fe and impurities, in a case where [Ti] represents a Ti content and [N] represents a N content by mass %, the chemical composition satisfies $([Ti]-3.43\times[N])>0.03$, and a total number density of a Ti carbide and a Ti carbonitride having a diameter of 5 nm to 100 nm is more than 50 piece/$\mu m^3$.

(2) The spring steel according to (1), may include, as the chemical composition, by mass %, Cu: 0.05% to 0.50%, in a case where [Cu] represents a Cu content and [Ni] represents a Ni content by mass %, the chemical composition may satisfy $[Cu]<([Ni]+0.1)$.

(3) The spring steel according to (1) or (2), may include: as the chemical composition, by mass %, one or more of Mo: 0.05% to 1.00%, V: 0.05% to 0.50%, and Nb: 0.01% to 0.10%.

(4) In the spring steel according to any one of (1) to (3), a tensile strength may be 1,800 MPa or more, a reduction of area may be 40% or more, and a Charpy impact value may be 70 J/cm$^2$ or more, after a quenching and a tempering.

(5) In the spring steel according to any one of (1) to (4), a tensile strength may be 1,800 MPa or more, and a delayed fracture strength ratio may be 0.40 or more, after quenching and tempering.

Effects of the Invention

According to the above aspect of the present invention, it is possible to obtain spring steel having a high tensile strength of 1,800 MPa or more after a heat treatment, in which a sufficient reduction of area and a sufficient Charpy impact value (toughness) are secured, and resistance to hydrogen embrittlement (delayed fracture resistance properties) is also high. This spring steel is suitable for a material for suspension spring.

EMBODIMENTS OF THE INVENTION

The present inventors have conducted research on a method of obtaining spring steel having high tensile strength and sufficient toughness after quenching and tempering. As a result, the present inventors have found that it is effective to finely disperse Ti carbonitride in steel before quenching and tempering, in order to obtain spring steel having sufficient toughness after quenching and tempering. That is, the present inventors have found that Ti carbonitride has a pinning effect of austenite grain growth, such that prior austenite grains of steel after quenching and tempering can be refined, and spring steel obtained by finely dispersing Ti carbonitride can have high strength, a high reduction of area, and high toughness after the heat treatment.

The present inventors have conducted research on a method of obtaining high resistance to hydrogen embrittlement together with toughness, after quenching and tempering. As a result, the present inventors have found that it is effective to include B in steel as chemical composition. B has a function of strengthening prior austenite grain boundaries that easily become origins of fracture, and thus it is possible to improve delayed fracture resistance properties of the steel after quenching and tempering, by including B in steel. However, the effect of including B is deteriorated, in a case where an amount of B in a solute state (the solid-soluted B) decreases by a formation of BN when B and N are combined. The present inventors have found that, in a case where both B and Ti are included in steel and a ratio of the B content and Ti content is controlled, Ti nitride and Ti carbonitride are primarily generated, and an amount of N that forms BN is decreased, such that the forming of BN and the decrease in the amount of the solid-soluted B can be suppressed.

The present inventors have found that embrittlement caused by a solid-soluted Ti can be suppressed by including both Ti and B in the steel. It is possible to include Ti in the spring steel with an amount in which there is a concern on the problem of embrittlement in a case where Ti is singly included in the steel.

The present inventors have found that it is effective to disperse Ti carbide (TiC) finely in steel before quenching and tempering in order to obtain spring steel having toughness at a high level after quenching and tempering. Since Ti carbide has a pinning effect of austenite grain growth, prior austenite grains of steel after quenching and tempering can be refined. Particularly, since Ti carbide is precipitated in a lower temperature than that in which Ti nitride and Ti carbonitride are precipitated, Ti carbide can be more finely and more abundantly precipitated in steel than Ti nitride and Ti carbonitride, and Ti carbide has an effect of refining austenite grains further than Ti nitride and Ti carbonitride.

In this manner, the present inventors have found that it is possible to obtain spring steel having a high tensile strength and having a high reduction of area, a high Charpy impact value, and a high resistance to hydrogen embrittlement after quenching and tempering, by using strengthening of prior austenite grain boundaries due to B in the steel, securing an amount of the solid-soluted B due to Ti carbonitride, and further refinement of prior austenite grain due to Ti carbide.

Hereinafter, a spring steel according to an embodiment of the present invention (a spring steel according to the present embodiment) is described. First, a chemical composition of the spring steel according to the present embodiment is described. Unless described otherwise, % with respect to components is mass %.

[C: 0.40% to 0.60%]

C is an element that causes a great influence on the strength of steel. In order to impart sufficient strength to the steel after quenching and tempering, it is required to set the C content to be 0.40% or more. The preferable lower limit of the C content is 0.45% and the more preferable lower limit thereof is 0.48%. On the other hand, in a case where the C content is excessive, untransformed austenite (residual austenite) in the steel after quenching is increased and the strengthening effect of C is decreased, and toughness is remarkably reduced. Therefore, the upper limit of the C content is set to 0.60%. The preferable upper limit of the C content is 0.58% and the more preferable upper limit thereof is 0.55%.

[Si: 0.90% to 2.50%]

Si increases the strength of the spring. In addition, Si improves resistance against settling (settling resistance), which is a shape change in the use of a spring. In order to obtain such an effect, in the spring steel according to the present embodiment, the Si content is set to 0.90% or more. The preferable lower limit of the Si content is 1.20% and the more preferable lower limit thereof is 1.60%. On the other hand, in a case where the Si content is excessive, the steel remarkably becomes brittle. Therefore, the upper limit of the Si content is set to 2.50%. The preferable upper limit of the Si content is 2.30% and more preferable upper limit thereof is 2.10%.

[Mn: 0.20% to 1.20%]

Mn improves hardenability of steel, so that Mn improves strength after quenching and tempering of steel. In addition, Mn is an essential element for suppressing embrittlement of steel by fixing S in steel as MnS. In order to obtain such an effect, in the spring steel according to the present embodiment, the Mn content is set to 0.20% or more. The preferable lower limit of the Mn content is 0.30% and the more preferable lower limit thereof is 0.40%. On the other hand, in a case where the Mn content is excessive, segregation of elements is encouraged, and thus the steel become brittle. Therefore, the upper limit of the Mn content is set to 1.20%. The preferable upper limit of the Mn content is 1.00% and the more preferable upper limit thereof is 0.60%.

[Cr: 0.15% to 2.00%]

Cr improves hardenability of steel and has an effect of suppressing precipitation of carbide. Therefore, Cr is an essential element for securing strength of the steel after quenching and tempering. In order to obtain such an effect, in the spring steel according to the present embodiment, the Cr content is set to 0.15% or more. The preferable lower limit of the Cr content is 0.25%, the more preferable lower limit thereof is 0.45%, and the even more preferable lower limit thereof is 0.60%. On the other hand, in a case where the Cr content is excessive, the steel remarkably becomes brittle. Therefore, the upper limit of the Cr content is set to 2.00%. The preferable upper limit of the Cr content is 1.50% and the more preferable upper limit is 1.00%.

[Ni: 0.10% to 1.00%]

Ni is an element that improves hardenability of steel and improves corrosion resistance of steel. In addition, Ni is an essential element for improving delayed fracture resistance properties by suppressing hydrogen penetration under the corrosion environment. In order to obtain such an effect, in the spring steel according to the present embodiment, the Ni content is set to 0.10% or more. The preferable lower limit of the Ni content is 0.15%. On the other hand, even though the Ni content is more than 1.00%, such an effect is saturated. Therefore, the upper limit of the Ni content is set to 1.00%. The preferable upper limit of the Ni content is 0.80%.

[Ti: 0.030% to 0.100%]

Ti improves the strength of steel and also has an effect of fixing N in steel by forming Ti nitride (TiN) due to combination with N. This effect for fixing N is necessary to obtain the following effect of the solid-soluted B. Therefore, it is required to contain a sufficient amount of Ti in order to fix N. In addition, a Ti nitride or a Ti carbonitride (Ti(C,N)) has an effect of suppressing the growth of austenite grains due to the pinning effect and an effect of refining prior austenite grains of steel after quenching and tempering. Furthermore, in the spring steel according to the present embodiment, prior austenite grains after quenching and tempering can be further refined by precipitating fine Ti carbide (TiC) abundantly due to bonding Ti and C. In order to obtain these effects, in the spring steel according to the present embodiment, the Ti content is set to 0.030% or more. The preferable lower limit of the Ti content is 0.045% and the more preferable lower limit thereof is 0.050%. On the other hand, in a case where the Ti content is excessive, coarse TiN which easily becomes an origin of fracture is formed, and steel is to be brittle. Therefore, the upper limit of the Ti content is set to 0.100%. The preferable upper limit of the Ti content is 0.090%.

[B: 0.0010% to 0.0060%]

B has an effect of improving hardenability of steel. B suppresses a segregation of P, S, and the like at prior austenite grain boundaries by primarily segregation at prior austenite grain boundaries that easily become origins of fractures. As a result, B is an element for contributing to an increase a strength at a grain boundary and an improvement in toughness. The above Ti is an element that may cause spring steel to be brittle, however embrittlement of steel caused by Ti can be suppressed due to the effect of improving toughness by B. In order to obtain these effects, it is required to suppress the forming of BN and increase an amount of B in a solid-soluted state. In order to obtain an effect of improving hardenability and an effect of improving strength at grain boundary, the B content in the spring steel according to the present embodiment is set to 0.0010% or more. The preferable lower limit of the B content is 0.0015% and the more preferable lower limit thereof is 0.0020%. On the other hand, even in a case where B is excessively contained, there is a concern that these effects become saturated and also toughness of steel may deteriorate. Therefore, the upper limit of the B content is set to 0.0060%. The preferable upper limit of the B content is 0.0050% and the more preferable upper limit thereof is 0.0040%.

[N: 0.0010% to 0.0070%]

N is an element of forming various kinds of nitride, and various kinds of carbonitride together with carbon (C) in steel. Nitride particles and carbonitride particles are stable even at a high temperature and suppress growing of austenite grains by grain boundary pinning effect. As a result, prior austenite grains can be refined by exhibiting this effect. In the spring steel according to the present embodiment, the N content is set to 0.0010% or more in order to refine prior austenite grains of steel after quenching and tempering, by precipitating Ti carbonitride (Ti(C,N)) particles, which are extremely stable, in the steel before quenching and tempering. The preferable lower limit of the N content is 0.0020%. On the other hand, in a case where the N content is excessive, Ti nitride particles or Ti carbonitride particles become coarse and are to be origins of fracture. As a result, toughness and/or fatigue properties are deteriorated. In addition, in a case where the N content is excessive, N and B are combined with each other to form BN and to decrease an amount of the solid-soluted B. As a result, there is a concern that effects in improving hardenability and strength at grain boundary by the above B are deteriorated. Therefore, the upper limit of the N content is 0.0070%. The preferable upper limit of the N content is 0.0050%.

$$[([Ti]-3.43\times[N])>0.03]$$

In the spring steel according to the present embodiment, prior austenite grains of steel after quenching and tempering are refined by using Ti carbide and Ti carbonitride. Particularly, Ti carbide is precipitated at a lower temperature than Ti nitride and Ti carbonitride, and thus, Ti carbide can be precipitated more finely and more abundantly than Ti nitride and Ti carbonitride. Therefore, Ti carbide has stronger effect of prior austenite grain refining than Ti nitride and Ti carbonitride. For this reason, in the spring steel according to the present embodiment, the chemical composition satisfies Expression 1 in order to sufficiently secure precipitated Ti as Ti carbide.

$$([Ti]-3.43\times[N])>0.03 \quad \text{(Expression 1)}$$

[Ti] and [N] in Expression 1 are a Ti content and a N content by mass %, and a numerical value of "3.43" is a value that can be obtained by dividing an atomic weight of Ti by an atomic weight of N. "3.43×[N]" is the maximum Ti content that can be consumed in the forming of TiN. In a case where the chemical composition satisfies Expression 1, the Ti content that is not consumed as TiN and Ti carbonitride is 0.03 mass % or more. Therefore, sufficient amount of Ti carbide for refining austenite grains can be obtained. A preferable lower limit of ([Ti]−3.43×[N]) is 0.04 mass %.

The upper limit of ([Ti]−3.43×[N]) is not particularly limited, and may be 0.100% which is an upper limit of the Ti content.

[P: less than 0.020%]

P is present in steel as an impurity element and causes the steel to be brittle. Particularly, P that is segregated at a prior austenite grain boundary causes a reduction of a Charpy impact value, or delayed fractures due to penetration of hydrogen. Therefore, the P content is preferably small. In order to prevent embrittlement of steel, the P content in the spring steel according to the present embodiment is limited to less than 0.020%. The preferable upper limit of the P content is 0.015%.

[S: less than 0.020%]

S is present in steel as an impurity element in the same manner as in P and causes steel to be brittle. Although S can be fixed as MnS by containing Mn into the steel, in a case where MnS becomes coarse, MnS functions as origins of fracture and deteriorates a Charpy impact value of steel or delayed fracture resistance properties. In order to suppress these adverse effects, the S content in the spring steel according to the present embodiment is limited to less than 0.020%. The preferable upper limit of the S content is 0.010%.

[Al: less than 0.050%]

Al is an element used as a deoxidizing element. However, in a case where the Al content is excessive, coarse inclusions are generated. As a result, a Charpy impact value deteriorates. Therefore, the Al content in the spring steel according to the present embodiment is limited to less than 0.050% so that the adverse effect does not become remarkable. The preferable upper limit of the Al content is 0.040%.

The chemical composition of the spring steel according to the present embodiment has the above essential composition and the remainder basically includes Fe and impurities. However, the spring steel according to the present embodiment may contain one or more of Cu, Mo, V, and Nb in the following range as the chemical composition. Here, Cu, Mo, V, and Nb are arbitrary elements, and the spring steel according to the present embodiment is not required to contain them as the chemical composition. The lower limit of each of the Cu content, Mo content, V content, and Nb content is 0%.

[Cu: 0% to 0.50%]

Cu has an effect of suppressing decarburization in the hot rolling. Cu also has an effect of improving corrosion resistance in the same manner as in Ni. In order to obtain these effects, the Cu content in the spring steel according to the present embodiment may be set to 0.05% or more. On the other hand, there is a concern that Cu reduces hot ductility of steel and Cu causes cracks during hot rolling. Since Ni has an effect of suppressing embrittlement caused by Cu, in a case where Cu is contained, the Cu content and the Ni content are controlled so as to satisfy Expression 2, and it is preferable that the upper limit of the Cu content is set to 0.50%. The more preferable upper limit of the Cu content is 0.30%.

$$[Cu]<([Ni]+0.1\%) \quad \text{(Expression 2)}$$

[Mo: 0% to 1.00%]

Mo improves hardenability of steel and increases resistance to temper softening, and thus has an effect of increasing the strength of steel after quenching and tempering. In order to obtain these effects, the Mo content may be set to 0.05% or more. On the other hand, in a case where the Mo content is more than 1.00%, the effect is saturated. Since Mo is an expensive element and it is not preferable that Mo is contained more than a necessary amount, in a case where Mo is contained, the upper limit of the Mo content is set to 1.00%. The preferable upper limit of the Mo content is 0.60%.

[V: 0% to 0.50%]

In the same manner as Ti, V forms nitride and carbide, exhibits a pinning effect that prevent austenite grains from growing, and thus has an effect of refining prior austenite grains after quenching and tempering. In order to obtain these effects, the V content may be set to 0.05% or more. In a case where the V content is more than 0.50%, coarse precipitates which are not solid-soluted are generated such that steel becomes brittle. Therefore, in a case where V is contained, the upper limit of the V content is set to 0.50%. The preferable upper limit of the V content is 0.30%.

[Nb: 0% to 0.10%]

In the same manner as Ti and V, Nb forms nitride and carbide, exhibits a pinning effect that prevents austenite grains from growing, and has an effect of refining prior austenite grains after quenching and tempering. In order to obtain these effects, the Nb content may be set to 0.01% or more. On the other hand, in a case where the Nb content is more than 0.10%, the coarse precipitates which are not solid-soluted are generated such that steel becomes brittle. Therefore, in a case where Nb is contained, the upper limit of the Nb content is set to 0.10%. The preferable upper limit of the Nb content is 0.06%.

The spring steel according to the present embodiment contains the above essential elements and contains the above arbitrary elements in some cases as the chemical composition, and the remainder thereof includes Fe and impurities. Contamination of an element other than the above elements as an impurity in steel from a raw material, a manufacturing device, and the like is allowable unless a contamination amount thereof is at a level that does not have an influence on properties of the steel.

Subsequently, characteristics of inclusion (precipitates) included in the spring steel according to the present embodiment are described.

[Number density of Ti carbide and Ti carbonitride having diameters of 5 nm to 100 nm: more than 50 piece/$\mu m^3$ in total]

In the spring steel according to the present embodiment, in order to achieve high strength, sufficient a reduction of area, and a sufficient Charpy impact value in steel after quenching and tempering, the growth of austenite grains are suppressed by Ti carbide and Ti carbonitride (hereinafter, Ti-based precipitates) dispersed finely and abundantly in steel before quenching and tempering.

In order to suppress the growth of the austenite grains, it is important to suitably control the number density of the Ti-based precipitates. On the other hand, since the Ti content has an upper limit, fine dispersion of the Ti-based precipitates contributes to the increase in the number density, and thus contributes to the suppression of the growth of the austenite grains.

In the spring steel according to the present embodiment, the number density of one of the Ti carbonitride and the Ti carbide used as the Ti-based precipitates or the sum of the number densities of both thereof is determined as described above, since Ti carbonitride and Ti carbide can be finely dispersed than Ti nitride because of lower precipitation temperature.

The present inventors have conducted research on the relationship between an average grain size of the Ti-based precipitates and a prior austenite grain size of steel after quenching and tempering. The counting of the number of the Ti-based precipitates is performed on the spring steel (steel before quenching and tempering) according to the present embodiment in an extraction replica method by a transmission electron microscope (TEM). Specifically, in a case where the state of the Ti-based precipitates of the spring steel according to the present embodiment is evaluated, the number Ns (piece/$\mu m^2$) of precipitated particles per unit area is measured in the TEM extraction replica method, and images of more than 5 visual fields are captured at an observation magnification of 200,000 times and the number and size of precipitated particles are observed. An image captured at an observation magnification of 500,000 is supplementarily used for the evaluation of fine precipitated particles. The fact that precipitated particles are Ti-based precipitates is confirmed by the EDS measurement. It is assumed that the precipitated particles evenly distribute, the number Nv of particles in a unit volume is estimated from Expression 3, by using the observed number Ns of precipitated particles per unit area and an average grain size d of the particles.

$$Ns/d \approx Nv \quad \text{(Expression 3)}$$

As a result of the research, the present inventors have found that there is a satisfactory relationship between the number density of the Ti-based precipitates having a diameter (equivalent circle diameter) of 5 nm or more and the prior austenite grain size. On the other hand, the present inventors have found that, in a case where the number density of these fine Ti-based precipitates are measured, the number of the Ti-based precipitates of 100 nm or more is small so that the influence thereof is negligibly small in the spring steel according to the present embodiment. The present inventors employed the number density of the Ti-based precipitates having a diameter of 5 nm to 100 nm as an index for obtaining an austenite grain refinement effect after quenching and tempering. The present inventors have found that Ti-based precipitates having a diameter of less than 5 nm do not have a sufficient pinning effect, and thus Ti-based precipitates having a diameter of less than 5 nm are not taken in consideration in the spring steel according to the present embodiment.

The present inventors have confirmed that the number density Nv of Ti-based precipitates having a diameter of 5 nm to 100 nm is more than 50/$\mu m^3$, in order to obtain spring steel having high strength, a sufficient reduction of area, and a sufficient Charpy impact value by refining prior austenite grains after quenching and tempering.

According to the above reasons, in the spring steel according to the present embodiment, the total number density Nv of fine Ti carbide and fine Ti carbonitride having a diameter of 5 nm to 100 nm is more than 50 piece/$\mu m^3$. The preferable lower limit of the total number density Nv is 70 piece/$\mu m^3$. It is not required to determine the upper limit of the total number density Nv, however, in view of the chemical composition of the spring steel according to the present embodiment, it is not desirable that the total number density Nv is 1,000 piece/$\mu m^3$ or more.

[Reduction of area after quenching and tempering: preferably 40% or more]

[Charpy Impact value after quenching and tempering: preferably 70 J/$cm^2$ or more]

[Tensile strength after quenching and tempering: preferably 1,800 MPa or more]

[Delayed fracture strength ratio after quenching and tempering: preferably 0.40 or more]

The spring steel according to the present embodiment has the above properties, and thus has a fine prior austenite grain size of the grain size number of about 10 after quenching and tempering are performed by a pinning effect of the Ti-based precipitates. The spring steel according to the present embodiment preferably has tensile strength of 1,800 MPa or more, a reduction of area of 40% or more, and a Charpy impact value of 70 J/$cm^2$ or more after quenching and tempering of steel.

The spring steel according to the present embodiment has a fine prior austenite grain size, so that uniformity of the metallographic structure is high and the localization of the strain in a case of distortion is suppressed, and thus the spring steel according to the present embodiment has satisfactory processing characteristics after quenching and tempering. The spring steel according to the present embodiment preferably has a reduction of area is 40% or more in the tensile test after quenching and tempering, in order to have formability equal to or higher than that of the material used in the related art having lower strength.

The spring steel according to the present embodiment has a fine prior austenite grain size after quenching and tempering, and thus has high crack propagation resistance in a case of impact fracture after quenching and tempering. The spring steel according to the present embodiment preferably has a Charpy impact value is 70 J/$cm^2$ or more in the Charpy impact test after quenching and tempering, in order to have toughness equal to or more than that of the material used in the related art having lower strength. In a case where the spring steel according to the present embodiment has these properties, mechanical components manufactured by using the spring steel according to the present embodiment have high reliability.

It is preferable that the spring steel according to the present embodiment has tensile strength of 1,800 MPa or more and a delayed fracture strength ratio of 0.40 or more after quenching and tempering. In the case where the spring steel according to the present embodiment has these properties, mechanical components manufactured by using the spring steel according to the present embodiment have high reliability and contribute to high performance.

The delayed fracture strength ratio can be obtained by a delayed fracture test. The delayed fracture test can be performed by performing cathodic hydrogen charge (1.0 mA/$cm^2$) in a $H_2SO_4$ aqueous solution having pH=3 and performing a constant load test, using the test piece having a parallel portion of φ 8 mm and a ring V notch (depth of 1 mm and apex angle of 60°) formed in this parallel portion. In this delayed fracture test, the delayed fracture strength ratio can be obtained by dividing the maximum load in which breaking is not caused after 200 hours elapses by the breaking load in the atmosphere.

As described above, in a case where quenching and tempering are performed, the spring steel according to the present embodiment preferably has a reduction of area of 40% or more, a Charpy impact value of 70 J/$cm^2$ or more, tensile strength of 1,800 MPa or more, and/or a delayed fracture strength ratio of 0.40 or more.

In a case where quenching and tempering are performed on the spring steel according to the present embodiment, the quenching heating temperature is preferably 900° C. to 1,050° C. and more preferably 900° C. to 1,000° C. in order to sufficiently refine austenite grains. It is preferable that tempering is performed by appropriately adjusting conditions such that the tensile strength after tempering becomes 1,800 MPa or more, and the tempering temperature is, for example, 350° C. to 500° C.

The spring steel according to the present embodiment is suitable as a material of a suspension spring or the like, and examples of the spring steel according to the present embodiment include a rolled wire rod that can be obtained by performing hot rolling on a steel ingot manufactured by steel making.

Subsequently, a preferable manufacturing method of the spring steel according to the present embodiment is described. The spring steel according to the present embodiment is not limited to a manufacturing method, and the effect thereof can be obtained as long as the spring steel according to the present embodiment has the above characteristics. However, according to the manufacturing method including the following steps, the spring steel according to the present embodiment can be easily manufactured, and is thus preferable.

The spring steel according to the present embodiment uses Ti carbide and Ti carbonitride finely dispersed in steel before quenching and tempering in order to refine austenite grains during heat treatment of quenching. Since the fine Ti carbide and the fine Ti carbonitride can be obtained by using particles precipitated in the solid phase after steel making, in the method of manufacturing the spring steel according to the present embodiment, it is important to manage the temperature and the treatment time in each of the steps after steel making such that these particles do not become coarse, and particularly it is important to control the heating step of steel ingot and the hot rolling step which are steps performed at the high temperature.

Generally, when heating and rolling is subjected to a steel ingot, in order to reduce internal unevenness, hot rolling is performed after heating in the high temperature and a long period of time, such as a heat treatment in which the temperature range of 1,250° C. or higher is held for 180 min or longer. However, in the spring steel according to the present embodiment, for example, when a steel ingot for hot rolling is heated, the steel ingot is heated to a temperature range of 950° C. to 1,100° C. and the corresponding temperature range is held for a time of 30 min to 120 min. In a case where the heating temperature of the steel ingot is lower than 950° C., there is a concern that the rolling resistance increases such that the productivity reduces. In addition, in a case where the holding time of the steel ingot is shorter than 30 min, soaking of the steel ingot is insufficient, and thus there is a concern about rolling fracture. On the other hand, in a case where the heating temperature of the steel ingot is more than 1,100° C. and in a case where the holding time of the steel ingot is longer than 120 min, the above precipitated particles become coarse, and thus there is a concern that the total number density Nv of fine Ti carbide and fine Ti carbonitride having a diameter of 5 nm to 100 nm is insufficient.

The steel ingot heated in the above conditions is subjected to hot rolling so as to obtain steel for the spring. In the case of hot rolling, the temperature of the steel ingot is not generally the heating temperature or higher, and thus the temperature of the steel ingot in a case of rolling is 1,100° C. or lower. However, in order to suppress the Ti-based precipitated particles from becoming coarse, it is preferable to set the temperature of the steel ingot in a case of rolling to be 1,050° C. or lower.

EXAMPLES

Examples of the present invention are described below, however, conditions in the examples are one condition example employed for checking the applicability and effect of the present invention, and the present invention is not limited to this condition example. The present invention may employ various conditions without departing from the gist of the present invention and as long as the object of the present invention is achieved.

Each of the components, ([Ti]−3.43×[N]), and ([Cu]—[Ni]) of examples and comparative examples are presented in Tables 1 and 2. In Tables 1 and 2, the reference "–" indicates that the corresponding element is not contained. In Tables 1 and 2, ([Cu]—[Ni]) in the examples and the comparative examples in which Cu is not included in the steel is not calculated. The examples and the comparative examples were manufactured by a manufacturing method including a step of heating a steel ingot before hot rolling in the temperature of 950° C. to 1,100° C. for a period of time of not more than 120 min, a step of performing hot rolling on the heated steel ingot, a step of performing quenching in the temperature of 900° C. to 1,050° C., and a step of performing tempering such that tensile strength becomes 1,900 to 2,000 MPa.

TABLE 1

(mass %) Remainder Fe and impurities

| | | C | Si | Mn | P | S | Cr | Ni | Al | Ti | N | B | Cu | Mo | V | Nb | Ti-3.43 N | Cu—Ni |
|---|---|---|---|---|---|---|---|---|---|---|---|---|---|---|---|---|---|---|
| Example | 1 | 0.50 | 2.00 | 0.50 | 0.005 | 0.005 | 0.90 | 0.25 | 0.020 | 0.070 | 0.0030 | 0.0025 | 0.25 | — | — | — | 0.060 | 0.000 |
| | 2 | 0.49 | 1.95 | 0.48 | 0.005 | 0.005 | 0.30 | 0.20 | 0.025 | 0.095 | 0.0030 | 0.0015 | 0.20 | — | — | — | 0.085 | 0.000 |
| | 3 | 0.53 | 2.05 | 0.60 | 0.006 | 0.005 | 1.00 | 0.30 | 0.022 | 0.056 | 0.0030 | 0.0035 | 0.30 | — | — | — | 0.046 | 0.000 |
| | 4 | 0.53 | 1.61 | 0.30 | 0.005 | 0.005 | 0.93 | 0.12 | 0.001 | 0.055 | 0.0025 | 0.0025 | 0.15 | 0.15 | — | — | 0.046 | 0.030 |
| | 5 | 0.58 | 1.06 | 0.49 | 0.012 | 0.010 | 1.21 | 0.15 | 0.030 | 0.061 | 0.0040 | 0.0023 | — | — | — | — | 0.047 | |
| | 6 | 0.42 | 2.40 | 0.48 | 0.012 | 0.013 | 1.81 | 0.15 | 0.031 | 0.068 | 0.0052 | 0.0025 | — | — | — | — | 0.050 | |
| | 7 | 0.48 | 1.99 | 1.15 | 0.010 | 0.012 | 0.60 | 0.16 | 0.025 | 0.070 | 0.0035 | 0.0031 | — | — | — | — | 0.058 | |
| | 8 | 0.49 | 2.00 | 0.49 | 0.008 | 0.008 | 0.89 | 0.51 | 0.021 | 0.070 | 0.0031 | 0.0030 | 0.45 | — | — | — | 0.059 | −0.060 |
| | 9 | 0.50 | 2.01 | 0.48 | 0.006 | 0.009 | 0.90 | 0.95 | 0.035 | 0.071 | 0.0027 | 0.0026 | — | — | — | — | 0.062 | |
| | 10 | 0.50 | 2.00 | 0.50 | 0.009 | 0.010 | 0.74 | 0.14 | 0.025 | 0.069 | 0.0035 | 0.0025 | — | 0.90 | — | — | 0.057 | |
| | 11 | 0.49 | 2.00 | 0.50 | 0.010 | 0.011 | 0.75 | 0.15 | 0.025 | 0.080 | 0.0063 | 0.0024 | — | — | 0.48 | — | 0.058 | |
| | 12 | 0.49 | 2.01 | 0.49 | 0.011 | 0.010 | 0.74 | 0.15 | 0.019 | 0.061 | 0.0031 | 0.0022 | — | — | — | 0.09 | 0.050 | |
| | 13 | 0.50 | 2.01 | 0.50 | 0.015 | 0.014 | 0.74 | 0.15 | 0.001 | 0.070 | 0.0030 | 0.0055 | — | — | — | — | 0.060 | |
| | 14 | 0.51 | 2.00 | 0.51 | 0.009 | 0.008 | 0.75 | 0.14 | 0.001 | 0.068 | 0.0029 | 0.0012 | — | — | — | — | 0.058 | |

TABLE 2

(mass %) Remainder Fe and impurities

| | | C | Si | Mn | P | S | Cr | Ni | Al | Ti | N | B | Cu | Mo | V | Nb | Ti-3.43 N | Cu—Ni |
|---|---|---|---|---|---|---|---|---|---|---|---|---|---|---|---|---|---|---|
| Compar- | 21 | 0.55 | 1.51 | 0.70 | 0.001 | 0.001 | 0.74 | 0.00 | 0.024 | 0.001 | 0.0040 | 0.0000 | — | — | — | — | −0.013 | |
| ative | 22 | 0.38 | 1.80 | 0.20 | 0.008 | 0.008 | 1.05 | 0.53 | 0.001 | 0.065 | 0.0041 | 0.0001 | 0.31 | — | 0.17 | — | 0.051 | −0.220 |
| Example | 23 | 0.65 | 1.90 | 0.92 | 0.012 | 0.009 | 0.71 | 0.12 | 0.018 | 0.070 | 0.0052 | 0.0025 | — | — | — | — | 0.052 | |
| | 24 | 0.55 | 0.52 | 1.02 | 0.015 | 0.010 | 0.95 | 0.25 | 0.020 | 0.070 | 0.0045 | 0.0022 | — | 0.24 | — | 0.05 | 0.055 | |
| | 25 | 0.58 | 2.98 | 0.75 | 0.008 | 0.007 | 0.50 | 0.51 | 0.025 | 0.055 | 0.0025 | 0.0018 | — | — | — | — | 0.046 | |
| | 26 | 0.50 | 2.18 | 0.18 | 0.005 | 0.012 | 1.20 | 0.40 | 0.024 | 0.070 | 0.0028 | 0.0023 | 0.25 | — | — | — | 0.060 | −0.150 |
| | 27 | 0.55 | 1.40 | 0.70 | 0.025 | 0.015 | 0.70 | 0.10 | 0.001 | 0.070 | 0.0035 | 0.0024 | — | — | — | — | 0.058 | |
| | 28 | 0.55 | 1.40 | 0.69 | 0.012 | 0.030 | 0.70 | 0.12 | 0.001 | 0.065 | 0.0028 | 0.0025 | — | — | — | — | 0.055 | |
| | 29 | 0.54 | 1.80 | 0.30 | 0.009 | 0.010 | 2.45 | 0.30 | 0.020 | 0.075 | 0.0052 | 0.0019 | 0.25 | — | — | — | 0.057 | −0.050 |
| | 30 | 0.54 | 1.75 | 0.72 | 0.008 | 0.012 | 0.81 | 0.00 | 0.035 | 0.062 | 0.0042 | 0.0029 | — | — | — | — | 0.048 | |
| | 31 | 0.49 | 1.79 | 0.70 | 0.009 | 0.008 | 0.75 | 0.12 | 0.025 | 0.059 | 0.0032 | 0.0026 | 0.53 | — | — | — | 0.048 | 0.410 |
| | 32 | 0.49 | 1.72 | 0.30 | 0.005 | 0.002 | 0.28 | 0.21 | 0.020 | 0.027 | 0.0029 | 0.0020 | 0.12 | 0.29 | — | — | 0.017 | −0.090 |
| | 33 | 0.50 | 1.78 | 0.31 | 0.007 | 0.012 | 0.32 | 0.22 | 0.020 | 0.151 | 0.0042 | 0.0030 | 0.15 | — | — | — | 0.137 | −0.070 |
| | 34 | 0.49 | 2.15 | 0.98 | 0.011 | 0.008 | 0.29 | 0.20 | 0.023 | 0.060 | 0.0092 | 0.0033 | — | — | — | — | 0.028 | |
| | 35 | 0.52 | 2.15 | 0.94 | 0.005 | 0.005 | 0.33 | 0.20 | 0.022 | 0.083 | 0.0030 | 0.0000 | 0.24 | — | — | — | 0.073 | 0.040 |
| | 36 | 0.49 | 1.81 | 0.49 | 0.005 | 0.009 | 0.90 | 0.15 | 0.022 | 0.015 | 0.0042 | 0.0028 | — | — | — | — | 0.001 | |
| | 37 | 0.55 | 1.80 | 0.49 | 0.006 | 0.008 | 0.88 | 0.20 | 0.030 | 0.045 | 0.0050 | 0.0022 | — | — | — | — | 0.028 | |
| | 38 | 0.50 | 2.00 | 0.50 | 0.005 | 0.005 | 0.90 | 0.25 | 0.020 | 0.070 | 0.0030 | 0.0025 | 0.25 | — | — | — | 0.060 | 0.000 |

With respect to the obtained spring steel of the examples and the comparative examples, number density and mechanical properties (tensile strength, reduction of area, Charpy impact value, and delayed fracture strength ratio) after quenching and tempering of the Ti-based precipitates were examined. In all of the examples and the comparative examples, samples for observing the Ti-based precipitates were collected from samples before quenching and tempering, and quenching and tempering were performed such that steel of φ 14 mm to φ 16 mm became 1,900 MPa to 2,000 MPa, so as to collect test pieces for measuring mechanical properties.

The counting the number of the Ti-based precipitates was performed with respect to each of the samples before quenching and tempering in the extraction replica method by a transmission electron microscope (TEM). In the TEM extraction replica method, the number Ns (piece/$\mu m^2$) of the precipitated particles per unit area was measured, however, in a case of evaluating the state of the Ti-based precipitates of the spring steel according to the present embodiment, the number Nv of the particles in the unit volume was estimated from Expression 3 by using the number Ns of the precipitated particles per unit area and the average grain size d of the observed particles, assuming that the precipitated particles were evenly distributed. The fact that the precipitated particles were Ti-based precipitates was confirmed in the EDS measurement.

$$Ns/d \approx Nv \quad \text{(Expression 3)}$$

The tensile test was performed by manufacturing test piece having a parallel portion diameter of 8 mm in conformity with "JIS Z 2201" No. 14 test piece, so as to obtain tensile strength and a reduction of area. The charpy impact test was performed by manufacturing U-notched test pieces (notch lower height 8 mm, width 5 mm sub size) in conformity with "JIS Z 2204", so as to obtain a Charpy impact value at room temperature (23° C.).

The delayed fracture test was performed by performing cathodic hydrogen charge (1.0 mA/$cm^2$) in a $H_2SO_4$ aqueous solution having pH=3 and performing a constant load test, using the test piece having a parallel portion of φ 8 mm and a ring V notch (depth of 1 mm and apex angle of 60°) formed in this parallel portion. The delayed fracture strength ratios of the examples and the comparative examples were obtained by dividing the maximum load in which each kind of steel was not broken after 200 hours elapsed by the breaking load in the atmosphere, so as to compare resistance to hydrogen embrittlement (delayed fracture resistance properties) of the examples and the comparative examples.

The number density and the mechanical characteristics (tensile strength, reduction of area, Charpy impact value, and delayed fracture strength ratio) of the Ti-based precipitates of the examples and the comparative examples are indicated in Tables 3 and 4.

TABLE 3

| | | Steel ingot heating temperature (° C.) | TiC + Ti(C, N) (piece/$\mu m^3$) | Tensile strength (MPa) | Reduction of area (%) | Charpy impact value (J/$cm^2$) | Delayed fracture strength ratio |
|---|---|---|---|---|---|---|---|
| Example | 1 | 1080 | 120 | 1933 | 55 | 91.1 | 0.44 |
| | 2 | 1080 | 150 | 1928 | 48 | 80.3 | 0.42 |
| | 3 | 1080 | 70 | 1942 | 55 | 92.5 | 0.44 |
| | 4 | 1080 | 80 | 1925 | 51 | 85.6 | 0.45 |

TABLE 3-continued

| | | Steel ingot heating temperature (° C.) | TiC + Ti(C, N) (piece/$\mu m^3$) | Tensile strength (MPa) | Reduction of area (%) | Charpy impact value (J/$cm^2$) | Delayed fracture strength ratio |
|---|---|---|---|---|---|---|---|
| | 5 | 1040 | 90 | 1935 | 58 | 96.5 | 0.46 |
| | 6 | 1080 | 90 | 1937 | 45 | 75.2 | 0.41 |
| | 7 | 1080 | 110 | 1927 | 48 | 80.3 | 0.42 |
| | 8 | 1040 | 140 | 1925 | 54 | 98 | 0.45 |
| | 9 | 1040 | 140 | 1919 | 56 | 102.5 | 0.46 |
| | 10 | 1080 | 90 | 1972 | 52 | 87.7 | 0.43 |
| | 11 | 1080 | 80 | 1964 | 55 | 92.7 | 0.46 |
| | 12 | 1080 | 70 | 1932 | 51 | 79.4 | 0.42 |
| | 13 | 1080 | 100 | 1925 | 55 | 88 | 0.44 |
| | 14 | 1080 | 100 | 1948 | 49 | 84.2 | 0.42 |

TABLE 4

| | | Steel ingot heating temperature (° C.) | TiC + Ti(C, N) (piece/$\mu m^3$) | Tensile strength (MPa) | Reduction of area (%) | Charpy impact value (J/$cm^2$) | Delayed fracture strength ratio |
|---|---|---|---|---|---|---|---|
| Comparative Example | 21 | 1080 | 0 | 1965 | 35 | 60.5 | 0.34 |
| | 22 | 1080 | 70 | 1925 | 34 | 48.4 | 0.32 |
| | 23 | 1080 | 80 | 1952 | 44 | 65.8 | 0.42 |
| | 24 | 1080 | 90 | 1944 | 51 | 82.5 | 0.31 |
| | 25 | 1080 | 70 | 1932 | 35 | 52.8 | 0.43 |
| | 26 | 1080 | 120 | 1944 | 42 | 64.9 | 0.34 |
| | 27 | 1080 | 100 | 1936 | 32 | 44.6 | 0.29 |
| | 28 | 1080 | 90 | 1966 | 36 | 52.9 | 0.35 |
| | 29 | 1080 | 80 | 1954 | 38 | 79.8 | 0.40 |
| | 30 | 1080 | 70 | 1945 | 45 | 68.8 | 0.38 |
| | 31 | 1080 | 70 | | Not evaluated | | |
| | 32 | 1080 | 20 | 1954 | 51 | 77.6 | 0.37 |
| | 33 | 1080 | 180 | 1972 | 35 | 55.6 | 0.44 |
| | 34 | 1080 | 30 | 1934 | 36 | 52.8 | 0.35 |
| | 35 | 1080 | 120 | 1965 | 51 | 58.2 | 0.30 |
| | 36 | 1080 | 10 | 1921 | 35 | 52.9 | 0.32 |
| | 37 | 1080 | 10 | 1968 | 29 | 49.8 | 0.29 |
| | 38 | 1160 | 20 | 1940 | 33 | 62.2 | 0.36 |

In all the examples, the number of precipitation of the Ti precipitates was more than 50 piece/$\mu m^3$. These examples had tensile strength of 1,800 MPa or more, a reduction of area of 40% or more, a Charpy impact value of 70 J/$cm^2$ or more, and a delayed fracture strength ratio of 0.40 or more after quenching and tempering.

On the other hand, in each of Comparative Examples 21, 22, 25, 27, 28, 29, 33, 34, 36, and 37, a value of reduction of area was reduced by the reason that, Ni content, Ti content and B content were insufficient, C content was insufficient, Si content was excessive, P content was excessive, S content was excessive, Cr content was excessive, Ti content was excessive, N content was excessive, Ti content was insufficient, and ([Ti]−3.43×[N]) was not satisfied, respectively.

In addition, in each of Comparative Examples 21, 22, 23, 25, 26, 27, 28, 30, 33, 34, 35, 36, and 37, embrittlement occurred or the structure became coarse, and thus the Charpy impact value was reduced by the reason that, Ni content, Ti content and B content were insufficient, C content was insufficient, C content was excessive, Si content was excessive, Mn content was insufficient, P content was excessive, S content was excessive, Ni content was insufficient, Ti content was excessive, N content was excessive, B content was insufficient, Ti content was insufficient, and ([Ti]−3.43×[N]) was not satisfied, respectively.

Furthermore, in each of Comparative Examples 21, 22, 24, 26, 27, 28, 30, 32, 34, 35, 36, and 37, the delayed fracture resistance properties were reduced due to embrittlement, deterioration in corrosion resistance, or coarsening of the structure, by the reason that Ni content, Ti content and B content were insufficient, C content was insufficient, Si content was insufficient, Mn content was insufficient, P content was excessive, S content was excessive, Ni content was insufficient, ([Ti]−3.43×[N]) was not satisfied, N content was excessive, B content was insufficient, Ti content was insufficient, and ([Ti]−3.43×[N]) was not satisfied, respectively.

In Comparative Example 31, the balance of the Ni—Cu contents was out of the range of the present invention, hot ductility was reduced, cracking occurred in the case of hot working, and thus a machine test was not performed.

Comparative Example 38 was an example in which the temperature of the steel ingot before rolling was increased to a predetermined temperature or higher, Ti precipitates became coarse due to the influence of the heating, and thus the number of precipitation was deficient. Therefore, the grain size in a case of quenching became coarse, the reduction of area, the Charpy impact value, and the delayed fracture resistance properties were reduced.

INDUSTRIAL APPLICABILITY

The spring steel according to the present invention has excellent mechanical characteristics after quenching and tempering, since prior austenite grains after quenching and tempering were refined. According to the present invention, it is possible to obtain spring steel which has high strength of 1,800 MPa or more, in which a sufficient reduction of area and a sufficient Charpy impact value are secured, and further in which resistance to hydrogen embrittlement is high.

The invention claimed is:

1. A spring steel comprising: as a chemical composition, by mass %,

C: 0.42% to 0.58%,
Si: 0.90% to 2.50%,
Mn: 0.20% to 1.20%,
Cr: 0.15% to 2.00%,
Ni: 0.10% to 1.00%,
Ti: 0.030% to 0.100%,
B: 0.0010% to 0.0060%,
N: 0.0010% to 0.0070%,
Cu: 0% to 0.50%,
Mo: 0% to 1.00%,
V: 0% to 0.50%,
Nb: 0% to 0.10%,
P: limited to less than 0.020%,
S: limited to less than 0.020%,
Al: limited to less than 0.050%, and
a remainder comprising Fe and impurities,
wherein, in a case where [Ti] represents a Ti content and [N] represents a N content by mass %, the chemical composition satisfies $$([Ti]-3.43\times[N])>0.03, \text{ and}$$

wherein a total number density of a Ti carbide and a Ti carbonitride having a diameter of 5 nm to 100 nm is more than 50 piece/$\mu m^3$,
wherein a tensile strength is 1,800 MPa or more, a reduction of area is 40% or more, and a Charpy impact value is 70 J/$cm^2$ or more, after a quenching and a tempering.

2. The spring steel according to claim 1,
wherein a delayed fracture strength ratio is 0.40 or more, after a quenching and a tempering.

3. A spring steel comprising: as a chemical composition, by mass %,

C: 0.42% to 0.58%,
Si: 0.90% to 2.50%,
Mn: 0.20% to 1.20%,
Cr: 0.15% to 2.00%,
Ni: 0.10% to 1.00%,
Ti: 0.030% to 0.100%,
B: 0.0010% to 0.0060%,
N: 0.0010% to 0.0070%,
Cu: 0% to 0.50%,
Mo: 0% to 1.00%,
V: 0% to 0.50%,
Nb: 0% to 0.10%,
P: limited to less than 0.020%,
S: limited to less than 0.020%,
Al: limited to less than 0.050%, and
a remainder comprising Fe and impurities,
wherein, in a case where [Ti] represents a Ti content and [N] represents a N content by mass %, the chemical composition satisfies $$([Ti]-3.43\times[N])>0.03, \text{ and}$$

wherein a total number density of a Ti carbide and a Ti carbonitride having a diameter of 5 nm to 100 nm is more than 50 piece/$\mu m^3$,
wherein a tensile strength is 1,800 MPa or more, and a delayed fracture strength ratio is 0.40 or more, after a quenching and a tempering.

4. A spring comprising: as a chemical composition, by mass %,

C: 0.40% to 0.60%,
Si: 0.90% to 2.50%,
Mn: 0.20% to 1.20%,
Cr: 0.15% to 2.00%,
Ni: 0.10% to 1.00%,
Ti: 0.030% to 0.100%,
B: 0.0010% to 0.0060%,
N: 0.0010% to 0.0070%,
Cu: 0% to 0.50%,
Mo: 0% to 1.00%,
V: 0% to 0.50%,
Nb: 0% to 0.10%,
P: limited to less than 0.020%,
S: limited to less than 0.020%,
Al: limited to less than 0.050%, and
a remainder comprising Fe and impurities,
wherein, in a case where [Ti] represents a Ti content and [N] represents a N content by mass %, the chemical composition satisfies $$([Ti]-3.43\times[N])>0.03, \text{ and}$$

wherein a total number density of a Ti carbide and a Ti carbonitride having a diameter of 5 nm to 100 nm is more than 50 piece/$\mu m^3$,
wherein a tensile strength is 1,800 MPa or more, a reduction of area is 40% or more, and a Charpy impact value is 70 J/$cm^2$ or more.

* * * * *